US011378096B2

(12) United States Patent
Yamashita et al.

(10) Patent No.: US 11,378,096 B2
(45) Date of Patent: Jul. 5, 2022

(54) CENTRIFUGAL COMPRESSOR

(71) Applicant: MITSUBISHI HEAVY INDUSTRIES COMPRESSOR CORPORATION, Tokyo (JP)

(72) Inventors: Shuichi Yamashita, Tokyo (JP); Jo Masutani, Tokyo (JP); Yoshiaki Shoji, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 17/049,161

(22) PCT Filed: Feb. 27, 2019

(86) PCT No.: PCT/JP2019/007626

§ 371 (c)(1),
(2) Date: Oct. 20, 2020

(87) PCT Pub. No.: WO2019/207950

PCT Pub. Date: Oct. 31, 2019

(65) Prior Publication Data

US 2021/0239129 A1 Aug. 5, 2021

(30) Foreign Application Priority Data

Apr. 26, 2018 (JP) ..... JP2018-084752

(51) Int. Cl.
*F04D 29/44* (2006.01)
*F04D 17/12* (2006.01)
(Continued)

(52) U.S. Cl.
CPC ..... *F04D 29/444* (2013.01); *F04D 17/122* (2013.01); *F04D 29/284* (2013.01); *F04D 29/4206* (2013.01)

(58) Field of Classification Search
None
See application file for complete search history.

(56) References Cited

U.S. PATENT DOCUMENTS 1,669,581 A 5/1928 Spencer
3,071,313 A 1/1963 Weisel
(Continued)

FOREIGN PATENT DOCUMENTS

GB 1273234 A 5/1972
JP S51-020729 B 6/1976
(Continued)

OTHER PUBLICATIONS

The Office Action dated Jul. 6, 2021, issued in relevant JP Application No. 2018-084752 (9 pages).
(Continued)

*Primary Examiner* — Michael Lebentritt
(74) *Attorney, Agent, or Firm* — Osha Bergman Watanabe & Burton LLP

(57) ABSTRACT

A centrifugal compressor includes: an impeller fixed on an outer periphery of a rotary shaft; a diffuser disposed at a radially outer side of the impeller; a casing accommodating the impeller and the diffuser; a scroll flow passage connected to an outlet of the diffuser, the scroll flow passage being formed into a scroll shape by a scroll inner peripheral wall and a scroll outer peripheral wall positioned at a radially outer side of the scroll inner peripheral wall; and a discharge pipe connected to the casing so as to form a discharge flow passage for guiding a fluid from the scroll flow passage to outside of the casing. The scroll inner peripheral wall is positioned at an inner side, in a radial direction, of the outlet of the diffuser, and the discharge pipe includes an inner wall surface which has a radially inner region.

9 Claims, 9 Drawing Sheets

(51) Int. Cl.
*F04D 29/28* (2006.01)
*F04D 29/42* (2006.01)

(56) References Cited

U.S. PATENT DOCUMENTS

| | | | | |
|---|---|---|---|---|
| 3,367,567 | A | 2/1968 | Burns | |
| 4,521,155 | A | 6/1985 | Osborn | |
| 2002/0023575 | A1 | 2/2002 | Gatley | |
| 2003/0235497 | A1* | 12/2003 | Meng | F04D 29/444 415/208.3 |
| 2009/0035122 | A1* | 2/2009 | Yagi | F04D 29/284 415/1 |
| 2009/0317248 | A1* | 12/2009 | Tanaka | F04D 17/122 415/224.5 |
| 2013/0302155 | A1* | 11/2013 | Tamaki | F04D 29/4213 415/203 |
| 2013/0343885 | A1* | 12/2013 | Iwakiri | F04D 29/4206 415/204 |
| 2015/0056062 | A1* | 2/2015 | Tamaki | F04D 27/0207 415/58.4 |
| 2016/0312786 | A1* | 10/2016 | Sarri | F04D 29/284 |
| 2017/0030373 | A1* | 2/2017 | Ravi | F04D 29/441 |
| 2018/0135647 | A1* | 5/2018 | Okada | F04D 29/444 |
| 2019/0010958 | A1* | 1/2019 | Wang | F04D 29/444 |
| 2019/0063457 | A1* | 2/2019 | Nakaniwa | F04D 29/441 |
| 2020/0208655 | A1* | 7/2020 | Kudo | F04D 29/4206 |

FOREIGN PATENT DOCUMENTS

| | | | |
|---|---|---|---|
| JP | H10-176699 | A | 6/1998 |
| JP | 2016-180400 | A | 10/2016 |
| WO | 2018-003632 | A1 | 1/2018 |

OTHER PUBLICATIONS

International Preliminary Report of PCT/JP2019/007626 dated Jun. 4, 2019 (10 pages).

International Preliminary Report on Patentability dated Nov. 5, 2020 in corresponding International (PCT) Application No. PCT/JP2019/007626 (18 pages).

The extended European Search Report dated Apr. 14, 2021, issued to the corresponding EP application No. 19792938.3 (8 pages).

* cited by examiner

CENTRIFUGAL COMPRESSOR

TECHNICAL FIELD

The present disclosure relates to a centrifugal compressor.

BACKGROUND ART

Patent Document 1 discloses, as an example of a conventional centrifugal compressor, a centrifugal compressor including a plurality of stages of impellers arranged in the axial direction and a plurality of diaphragms disposed at the radially outer side of the impellers.

This type of centrifugal compressor includes a scroll flow passage that communicates with a discharge outlet. The scroll flow passage normally has an inner peripheral wall formed by the outer peripheral surface of the diaphragm at the discharge side, and an outer peripheral wall formed by the inner peripheral surface of an annular spacer disposed between the discharge-side diaphragm and a diaphragm positioned next to the discharge-side diaphragm in the axial direction.

CITATION LIST

Patent Literature

Patent Document 1: JP2016-180400A

SUMMARY

Problems to be Solved

Meanwhile, when the diameter of the casing of a compressor is reduced in response to the need to reduce the size of compressors, the diameter of the diffuser also decreases and the flow velocity of the fluid at the outlet of the diffuser increases, which leads to an increase in the centrifugal force of the fluid. Furthermore, when the diameter of the casing of a compressor is reduced, the diameter of the scroll flow passage also decreases, which leads to an increase in the centrifugal force of the fluid in the vicinity of the scroll termination portion of the scroll flow passage.

Thus, due to size reduction of a compressor, the fluid may separate from the wall surface of the flow passage in a region from the vicinity of the scroll termination portion of the scroll flow passage to the outlet of the fluid from the compressor. When such separation occurs, the performance of the compressor deteriorates.

In view of the above, an object of at least one embodiment of the present invention is to suppress performance deterioration of the compressor due to size reduction of the compressor.

Solution to the Problems (1) According to at least one embodiment of the present invention, a centrifugal compressor includes: an impeller fixed on an outer periphery of a rotary shaft; a diffuser disposed at a radially outer side of the impeller; a casing accommodating the impeller and the diffuser; a scroll flow passage connected to an outlet of the diffuser, the scroll flow passage being formed into a scroll shape by a scroll inner peripheral wall and a scroll outer peripheral wall positioned at a radially outer side of the scroll inner peripheral wall; and a discharge pipe connected to the casing so as to form a discharge flow passage for guiding a fluid from the scroll flow passage to outside of the casing. The scroll inner peripheral wall is positioned at an inner side, in a radial direction, of the outlet of the diffuser, and the discharge pipe includes an inner wall surface which has a radially inner region continuing to the scroll inner peripheral wall, the radially inner region being positioned, when viewed in an axial direction of the rotary shaft, closer to a scroll termination portion of the scroll flow passage from a first line segment which passes a center of the rotary shaft and which is parallel to a center axis of an outlet portion of the discharge pipe, at a connection position of the discharge pipe to the casing.

With the above configuration (1), the discharge pipe has an inner wall surface which has a radially inner region continuing to the scroll inner peripheral wall, and the radially inner region is positioned closer to the scroll termination portion of the scroll flow passage from the first line segment which passes the center of the rotary shaft and which is parallel to the center axis of the outlet portion of the discharge pipe, at the connection position of the discharge pipe to the casing. Thus, it is possible to orient the direction of the flow passage of the fluid from the scroll termination portion of the scroll flow passage to the outlet portion of the discharge pipe outward in the radial direction. Accordingly, it is possible to suppress the centrifugal force of the fluid in the vicinity of the scroll termination portion and suppress separation of the fluid from the wall surface of the flow passage, thereby suppressing the performance deterioration of the compressor.

(2) In some embodiments, in the above configuration (1), a second line segment obtained by extending a center line of a width, in the radial direction, of the scroll flow passage in an extension direction at the scroll termination portion passes through an opening of the outlet portion of the discharge pipe.

With the above configuration (2). the flow passage of the fluid from the scroll termination portion of the scroll flow passage to the outlet portion of the discharge pipe is less bended, and it is possible to suppress pressure loss at the flow passage.

(3) In some embodiments, in the above configuration (1) or (2), the radially inner region has a linear shape portion formed into a linear shape from an inlet portion of the discharge pipe toward the outlet portion of the discharge pipe in at least a partial region between the inlet portion and the outlet portion, the partial region including the inlet portion.

With the above configuration (3), the radially inner region of the inner wall surface of the discharge pipe continuing to the scroll inner peripheral wall is formed into a linear shape in at least a partial region, and thus the discharge flow passage is less bended, which makes it possible to suppress pressure loss at the discharge flow passage.

(4) In some embodiments, in the above configuration (3), an intersecting angle between an extension direction of the linear shape portion from the inlet portion toward the outlet portion and an extension direction of the first line segment is not greater than 30 angular degrees when viewed in the axial direction of the rotary shaft.

If the intersecting angle between the above extension direction of the linear shape portion and the extension direction of the first line segment exceeds 30 angular degrees when viewed in the axial direction of the rotary shaft, the direction of the flow passage of the fluid from the scroll termination portion of the scroll flow passage to the outlet portion of the discharge pipe becomes more inward in the radial direction, and thereby the centrifugal force of the fluid in the vicinity of the scroll termination portion increases, which makes separation of the fluid from the wall surface of the flow passage more likely to occur.

In this regard, with the above configuration (4), the above intersecting angle is not greater than 30 angular degrees. Thus, it is possible to orient the flow passage of the fluid from the scroll termination portion of the scroll flow passage to the outlet portion of the discharge pipe less inward in the radial direction, and suppress the centrifugal force of the fluid in the vicinity of the scroll termination portion of the scroll flow passage, thereby suppressing separation of the fluid from the wall surface of the flow passage.

(5) In some embodiments, in the above configuration (4), the extension direction of the linear shape portion from the inlet portion toward the outlet portion coincides with the extension direction of the first line segment, when viewed in the axial direction of the rotary shaft.

With the above configuration (5), the intersecting angle between the above extension direction of the linear shape portion and the extension direction of the first line segment is zero angular degrees, when viewed in the axial direction of the rotary shaft, and thus it is possible to further suppress the centrifugal force of the fluid in the vicinity of the scroll termination portion of the scroll flow passage, and further suppress separation of the fluid from the wall surface of the fluid from the scroll termination portion of the scroll flow passage to the outlet portion of the discharge pipe.

(6) In some embodiments, in any one of the above configurations (1) to (5), a separation distance between the first line segment and the radially inner region at the connection position of the discharge pipe to the casing is not smaller than 0.2 times a minimum curvature radius of the scroll inner peripheral wall, when viewed in the axial direction of the rotary shaft.

If the separation distance between the radially inner region at the connection position of the discharge pipe to the casing and the first line segment is less than 0.2 times the minimum curvature radius of the scroll inner peripheral wall, when viewed in the axial direction of the rotary shaft, the direction of the flow passage of the fluid from the scroll termination portion of the scroll flow passage to the radially inner region at the connection position becomes more inward in the radial direction, and thereby the centrifugal force of the fluid in the vicinity of the scroll termination portion increases, which makes separation of the fluid from the wall surface of the flow passage more likely to occur.

In this regard, with the above configuration (6), the separation distance between the radially inner region at the connection position and the first line segment is not less than 0.2 times the minimum curvature radius of the scroll inner peripheral wall. Thus, it is possible to orient the flow passage of the fluid from the scroll termination portion of the scroll flow passage to the radially inner region at the connection position less inward in the radial direction, and suppress the centrifugal force of the fluid in the vicinity of the scroll termination portion, thereby suppressing separation of the fluid from the wall surface of the flow passage.

(7) In some embodiments, in the above configuration (6), the separation distance between the first line segment and the radially inner region at the connection position of the discharge pipe to the casing is equal to the minimum curvature radius of the scroll inner peripheral wall, when viewed in the axial direction of the rotary shaft.

With the above configuration (7), it is possible to further suppress the centrifugal force of the fluid in the vicinity of the scroll termination portion of the scroll flow passage, and further suppress separation of the fluid from the wall surface of the flow passage of the fluid from the scroll termination portion of the scroll flow passage to the radially inner region at the above connection position.

(8) In some embodiments, in any one of the above configurations (1) to (7), a separation distance between the first line segment and a center axis of the outlet portion of the discharge pipe when viewed in the axial direction of the rotary shaft is not smaller than 0.3 times a minimum curvature radius of the scroll inner peripheral wall.

If the separation distance between the center axis of the outlet portion of the discharge pipe and the first line segment is less than 0.3 times the minimum curvature radius of the scroll inner peripheral wall, when viewed in the axial direction of the rotary shaft, the direction of the flow passage of the fluid from the scroll termination portion of the scroll flow passage to the outlet portion of the discharge pipe becomes more inward in the radial direction, and thereby the centrifugal force of the fluid in the vicinity of the scroll termination portion increases, which makes separation of the fluid from the wall surface of the flow passage more likely to occur.

In this regard, with the above configuration (8), the separation distance between the center axis of the outlet portion of the discharge pipe and the first line segment is not less than 0.3 times the minimum curvature radius of the scroll inner peripheral wall. Thus, it is possible to orient the flow passage of the fluid from the scroll termination portion of the scroll flow passage to the outlet portion of the discharge pipe less inward in the radial direction, and suppress the centrifugal force of the fluid in the vicinity of the scroll termination portion, thereby suppressing separation of the fluid from the wall surface of the flow passage.

(9) In some embodiments, in any one of the above configurations (1) to (8), an inner wall surface of the discharge pipe has a changing portion whose cross-sectional shape viewed in an extension direction of the discharge flow passage has a rectangular shape at an inlet portion of the discharge pipe and a circular shape at the outlet portion, the cross-sectional shape gradually changing from the rectangular shape toward the circular shape from the inlet portion toward the outlet portion. The inner wall surface of the discharge pipe at the changing portion has an inner side wall surface continuing to the scroll inner peripheral wall and an outer side wall surface continuing to the scroll outer peripheral wall and facing the inner side wall surface. The radially inner region includes a region of the inner side wall surface.

With the above configuration (9), the cross-sectional shape gradually changes from a rectangular shape toward a circular shape at the change portion from the inlet portion toward the outlet portion of the discharge pipe, and thus the cross-sectional shape does not change abruptly, which makes it possible to suppress separation of the fluid from the inner side wall surface in the discharge pipe.

(10) In some embodiments, in any one of the above configurations (1) to (9), the radially inner region includes a protruding portion formed so as to protrude toward an inner side of the discharge flow passage, in at least a partial region between an inlet portion of the discharge pipe and the outlet portion.

With the above configuration (10), the protruding portion is formed in a region of the discharge flow passage where separation of the fluid is likely to occur, and thus it is possible to suppress separation of the fluid from the wall surface of the discharge flow passage.

Advantageous Effects

According to at least one embodiment of the present invention, it is possible to suppress performance deterioration of a compressor due to size reduction of a compressor.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Hereinafter, as an example of a centrifugal compressor, a multi-stage centrifugal compressor including a plurality of stages of impellers will be described.

Figure 1:
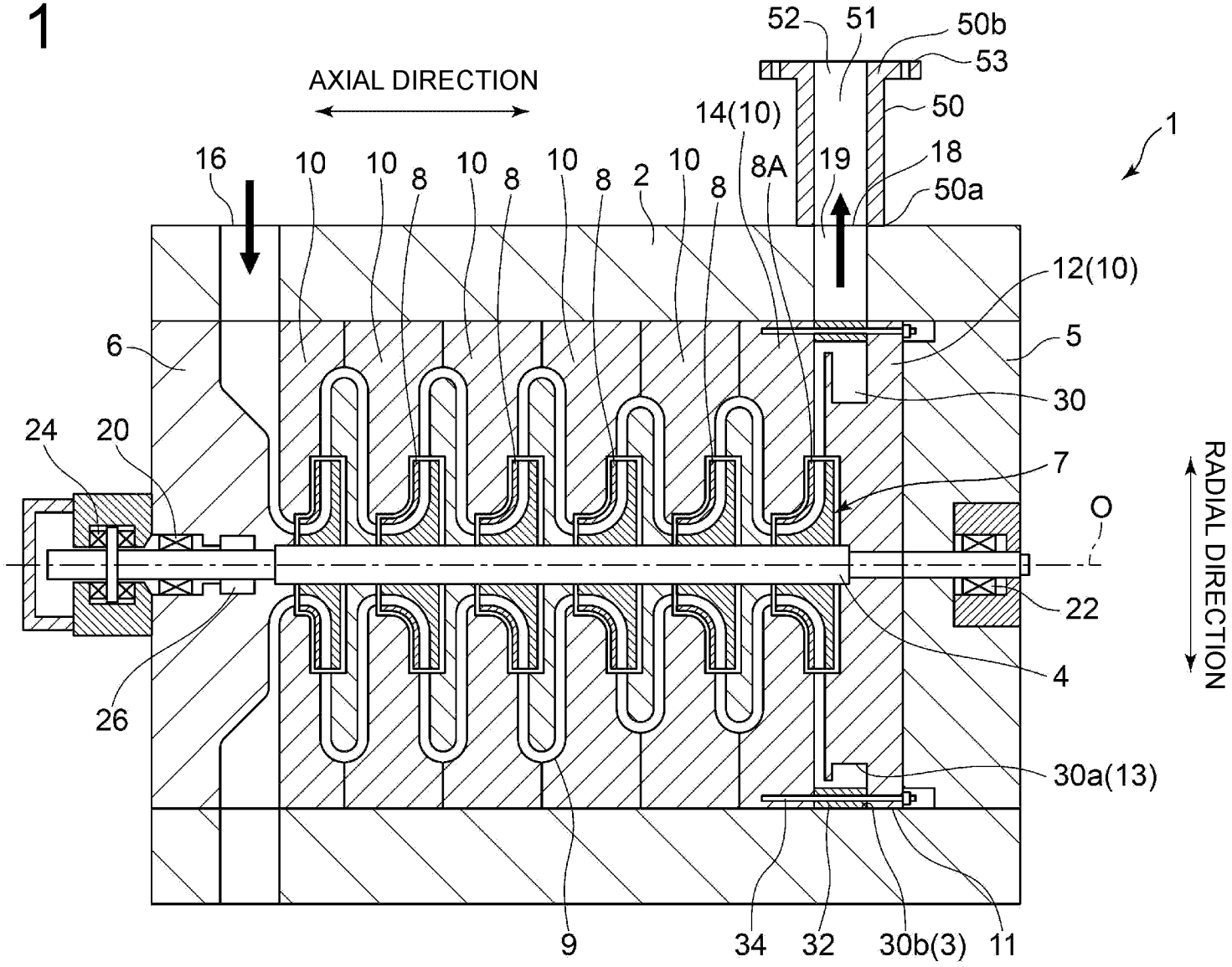
FIG. 1 is a cross-sectional view of a centrifugal compressor according to some embodiments, taken along the axial direction of the rotary shaft of the centrifugal compressor.
Figure 2:
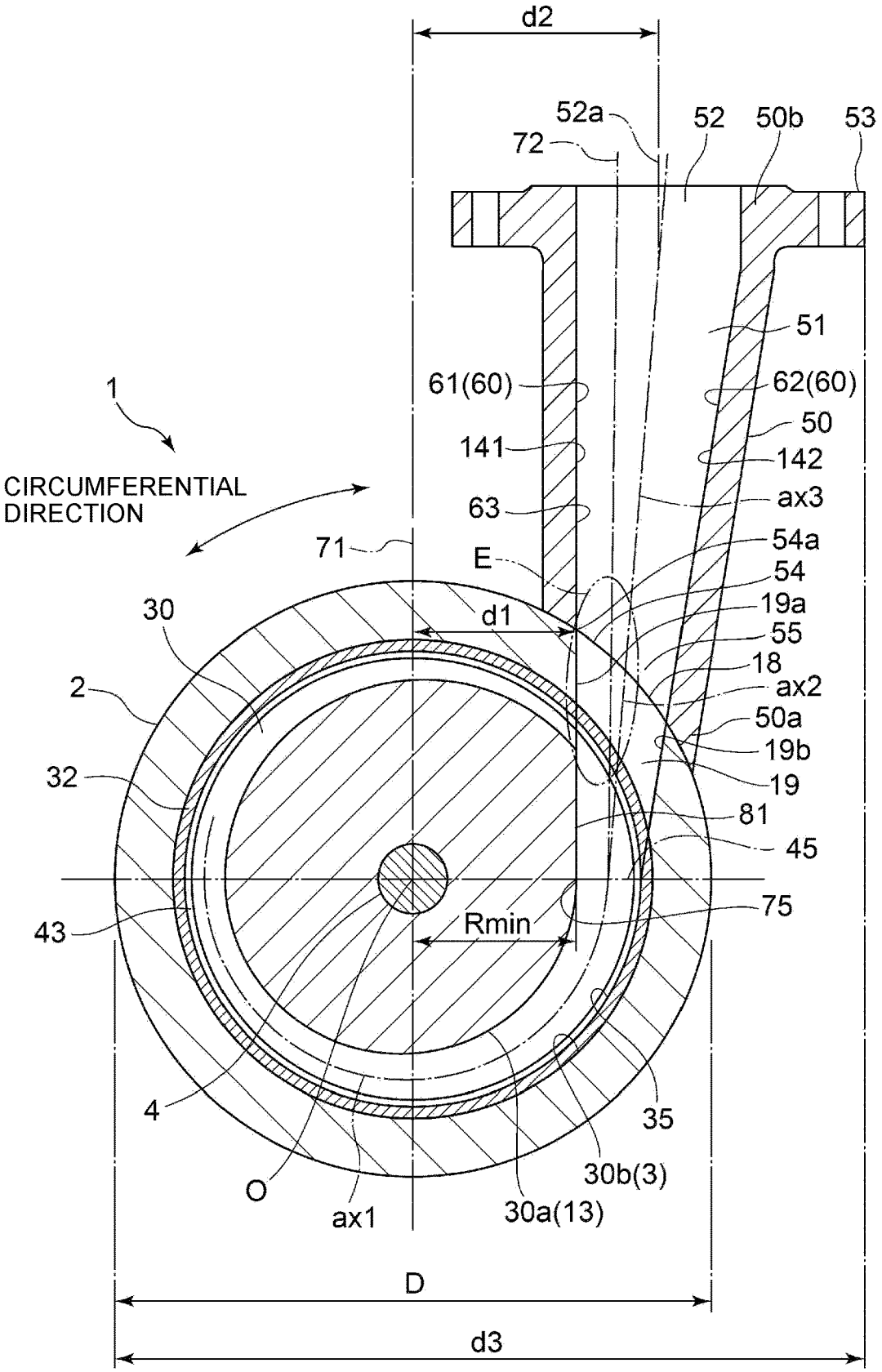
FIG. 2 is a cross-sectional view at a discharge outlet of a centrifugal compressor according to an embodiment, taken along the radial direction.

FIG. 1 is a cross-sectional view of a centrifugal compressor according to some embodiments, taken along the axial direction. FIG. 2 is a cross-sectional view at a discharge outlet of a centrifugal compressor according to an embodiment, taken in the radial direction.

As depicted in FIG. 1, the centrifugal compressor 1 includes a casing 2, and a rotor 7 supported rotatably inside the casing 2. The rotor 7 has a rotary shaft 4, and a plurality of stages of impellers 8 fixed to the outer surface of the shaft 4.

Inside the casing 2, accommodated is a plurality of diaphragms 10 arranged in the axial direction. The plurality of diaphragms 10 are disposed so as to surround the impellers 8 from the radially outer side. Furthermore, casing heads 5, 6 are disposed on both sides of the plurality of diaphragms 10 in the axial direction at the radially inner side of the casing 2.

The rotor 7 is supported rotatably by the radial bearings 20, 22 and the thrust bearing 24, and is configured to rotate about the center O.

An introducing inlet 16 through which a fluid flows in from outside is disposed on the first end portion of the casing 2, and a discharge outlet 18 for discharging a fluid compressed by the centrifugal compressor 1 to the outside is disposed on the second end portion of the casing 2. Inside the casing 2, a flow passage 9 is formed so as to bring the gaps between the plurality of stages of impellers 8 into communication. The introducing inlet 16 and the discharge outlet 18 are in communication with one another via the plurality of impellers 8 and the flow passage 9.

The first end 50*a* of a discharge pipe 50 connected to the casing 2 is connected to the discharge outlet 18.

The discharge pipe 50 has a discharge flow passage 51 formed inside, for guiding the fluid from the scroll flow passage 30 to the outside of the casing 2. An inlet portion 55 at the side of the first end 50*a* of the discharge flow passage 51 is in communication with an outlet flow passage 19 formed on the casing 2. A flange portion 53 for connecting to an external pipe, for instance, is formed at the radially outer side of the outlet portion 52 at the side of the second end 50*b* of the discharge flow passage 51.

In the depicted embodiment, the flow passage 9 inside the casing 2 is formed at least partially by the plurality of diaphragms 10.

As depicted in FIGS. 1 and 2, a scroll flow passage 30 is formed between the discharge outlet 18 of the casing 2 and the final-stage impeller 8A disposed most downstream of the plurality of stages of impellers 8. The scroll flow passage 30 is an annular flow-passage disposed such that the flow-passage cross-sectional area changes along the circumferential direction. Furthermore, the scroll flow passage 30 and the discharge outlet 18 are connected to one another via the outlet flow passage 19 of the casing 2.

The fluid flows into the centrifugal compressor 1 via the introducing inlet 16, and then flows from the upstream toward the downstream through the plurality of stages of impellers 8 and the flow passage 9. When passing through the plurality of stages of impellers 8, a centrifugal force of the impellers 8 is applied to the fluid, and the fluid is compressed in stages. The compressed fluid after passing the final-stage impeller 8A disposed most downstream of the plurality of stages of impellers 8 is guided to the outside of the casing 2 via the scroll flow passage 30 and the discharge outlet 18, and is discharged from the outlet portion 52 of the discharge flow passage 51 via the discharge pipe 50.

Furthermore, for the penetration portions at which the shaft 4 penetrates the casing heads 5, 6, a shaft sealing device may be provided to prevent leakage of the fluid through the penetration portion. In the embodiment depicted in FIG. 1, a shaft sealing device 26 is disposed on the casing head 6 at the side of the introducing inlet 16.

As depicted in FIG. 1, the plurality of diaphragms 10 include the first diaphragm 12 having a surface that forms the scroll flow passage 30, and a second diaphragm 14 disposed next to the first diaphragm 12 in the axial direction.

Figure 3:
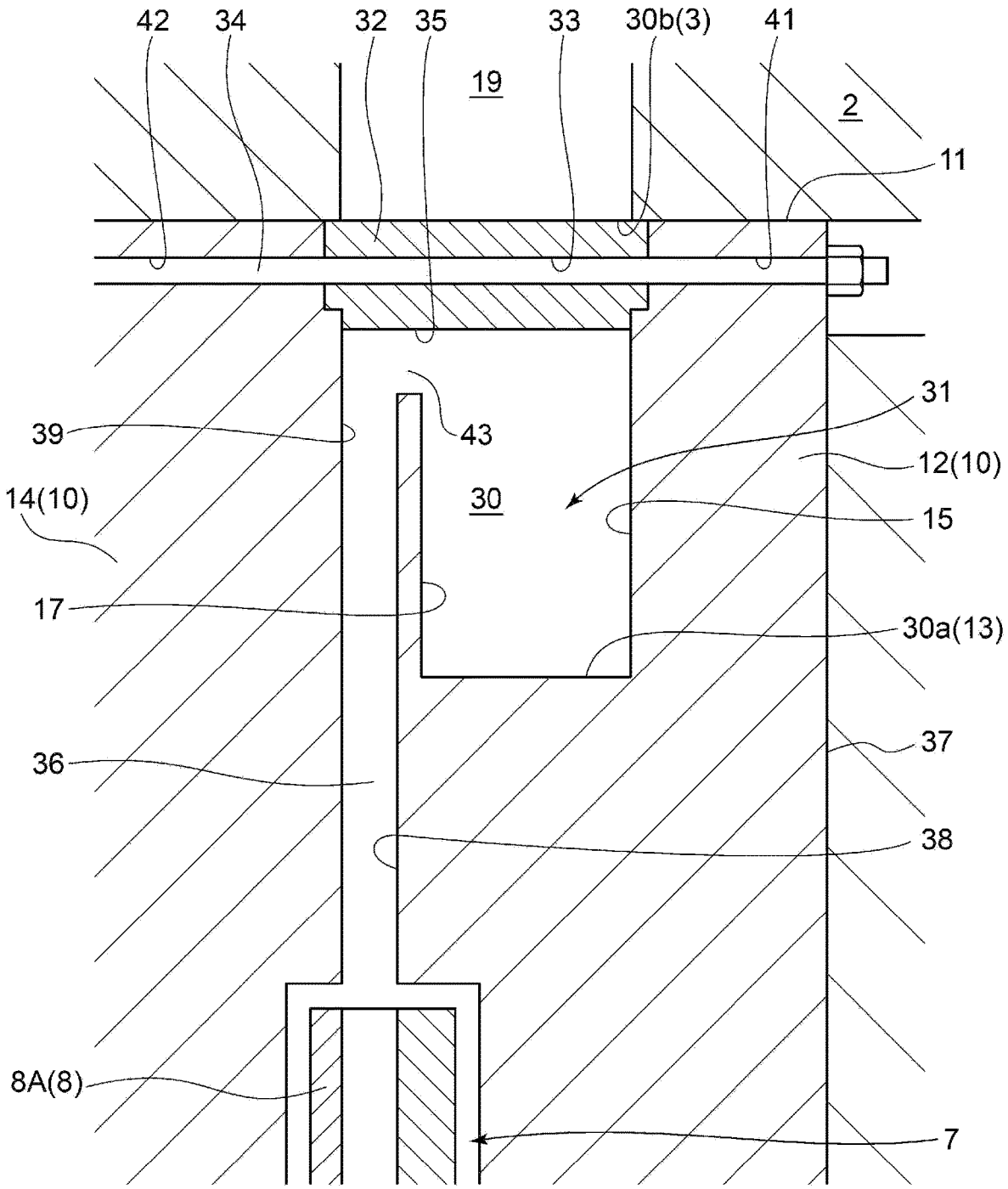
FIG. 3 is a cross-sectional view of the centrifugal compressor depicted in FIG. 1, showing an enlarged view mainly including the first diaphragm and the second diaphragm.

FIG. 3 is a cross-sectional view of the centrifugal compressor 1 depicted in FIG. 1, showing an enlarged view that mainly includes the first diaphragm 12 and the second diaphragm 14.

In the embodiment depicted in FIGS. 1 to 3, the first diaphragm 12 and the second diaphragm 14 are fastened by bolts 34 and thereby connected. The first diaphragm 12 and the second diaphragm 14 have bolt holes 41, 42 (see FIG. 3) each of which has a female thread formed thereon. As the bolts 34 are screwed into the bolt holes 41, 42, the first diaphragm 12 and the second diaphragm 14 are fastened to one another.

In the embodiment depicted in FIGS. 1 to 3, the axial-directional spacer 32 positioned between the first diaphragm 12 and the second diaphragm 14 includes a bolt insertion hole 33 (see FIG. 3) on which a female thread is formed. With the above described bolts 34 screwed into the bolt holes 41, 42 and the bolt insertion hole 33, the first diaphragm 12 and the second diaphragm 14 are fastened in a state where the axial-directional spacer 32 is interposed between the first diaphragm 12 and the second diaphragm 14. By providing the axial-directional spacer 32, it is possible to determine the position of the first diaphragm 12 with respect to the second diaphragm 14 in the axial direction.

In some embodiments, the first diaphragm 12 and the second diaphragm 14 may be joined by welding.

Furthermore, a pair of diaphragms 10 other than the pair of the first diaphragm 12 and the second diaphragm 14 may be joined by welding.

The first diaphragm 12 has a first end surface 37 and a second end surface 38 which are the opposite end surfaces in the axial direction. The first end surface 37 is an end surface next to the casing head 5 positioned at the side of the discharge outlet 18, and the second end surface 38 is an end surface next to the second diaphragm 14. Furthermore, in the positional range in the axial direction between the first end surface 37 and the second end surface 38, a recess portion 31 recessed inward in the radial direction from the outer peripheral surface 11 of the first diaphragm 12 is formed. The recess portion 31 has a pair of side surfaces 15, 17 along the radial direction and a bottom surface 13 along the circumferential direction. That is, the bottom surface 13 is a surface positioned at the radially inner side of the outer peripheral surface 11.

As depicted in FIGS. 2 and 3, the scroll flow passage 30 is formed into a scroll shape by a scroll inner peripheral wall 30*a* being the wall surface at the radially inner side, and a scroll outer peripheral wall 30*b* being the wall surface at the radially outer side, positioned at the radially outer side of the scroll inner peripheral wall 30*a*. Furthermore, the scroll inner peripheral wall 30*a* is formed by the bottom surface 13 of the above described recess portion 31 of the first diaphragm 12 (surface of the first diaphragm positioned at the radially inner side of the outer peripheral surface 11), and the scroll outer peripheral wall 30*b* is formed by the inner peripheral surface of the axial-directional spacer 32 (spacer inner peripheral wall 35).

As depicted in FIGS. 2 and 3, the pair of side surfaces 15, 17 of the recess portion 31 of the first diaphragm 12 each form a wall surface along the radial direction of the scroll flow passage 30.

That is, the scroll flow passage 30 has a rectangular cross-sectional shape when viewed in the extension direction of the scroll flow passage 30, that is, the circumferential direction. In the following description, a virtual curve along the circumferential direction passing through the center of the cross section viewed in the circumferential direction of the scroll flow passage 30 will be referred to as the center line ax1 of the scroll flow passage 30.

Although not depicted, the axial-directional spacer 32 may be disposed on the diffuser 36 disposed at the radially outer side of the final-stage impeller 8A. That is, the axial-directional spacer 32 may be disposed between the end surfaces of the first diaphragm 12 and the second diaphragm 14 that face one another (i.e., the second end surface 38 of the first diaphragm 12 and the end surface 29 of the second diaphragm 14). In this case, the scroll outer peripheral wall 30*b* is formed by the inner peripheral surface 3 of the casing 2.

The scroll flow passage 30 is connected to the outlet 43 of the diffuser 36.

The inner peripheral surface 3 of the casing 2 forming the scroll outer peripheral wall 30*b* may be a cylindrical shape centered at the rotational center (the center O of the rotary shaft 4) of the centrifugal compressor 1.

As described above, in a case where the inner peripheral surface 3 of the casing 2 forming the scroll outer peripheral wall 30*b* has a cylindrical shape centered at the rotational center of the centrifugal compressor 1, it is possible to form the scroll flow passage 30 easily by utilizing the inner peripheral surface 3 having a cylindrical shape.

That is, while the scroll inner peripheral wall 30*a* is formed by the bottom surface 13 (surface) of the recess portion 31 of the first diaphragm 12, it is possible to form the scroll outer peripheral wall 30*b* with the inner peripheral surface 3 of the casing 2 having a simple cylindrical shape. Thus, it is possible to form the scroll flow passage 30 relatively easily without forming a complicated flow passage shape on the casing 2 by machining.

Furthermore, since the inner peripheral surface 3 of the casing 2 forming the scroll outer peripheral wall 30*b* has a cylindrical shape centered at the center O and is coaxial with the rotor 7, it is possible to simplify the structure of the centrifugal compressor 1.

Meanwhile, when the diameter of the casing 2 of the centrifugal compressor 1 is reduced in response to the need reduce the size of compressors, the diameter of the diffuser 36 also decreases and the flow velocity of the fluid at the outlet 43 of the diffuser 36 increases, which leads to an increase in the centrifugal force of the fluid. Furthermore, when the diameter of the casing 2 of the centrifugal compressor 1 is reduced, the diameter of the scroll flow passage 30 also decreases, and thus the centrifugal force of the fluid increases in the vicinity of the scroll termination portion 45 of the scroll flow passage 30.

Thus, due to size reduction of the centrifugal compressor 1, the fluid may separate from the wall surface of the flow passage in a region from the vicinity of the scroll termination portion 45 of the scroll flow passage 30 to the outlet of the fluid from the centrifugal compressor 1. When such separation occurs, the performance of the centrifugal compressor 1 deteriorates. The region E surrounded by the two-dotted chain line in FIG. 2 and FIG. 4 described below is a region where the above separation is likely to occur.

Thus, according to some embodiments, the centrifugal compressor 1 is configured to suppress the above described separation with the configuration described below.

In some embodiments, the scroll termination portion 45 of the scroll flow passage 30 refers to the position of the scroll flow passage 30 corresponding to the position 75 where the scroll inner peripheral wall 30*a* has a curvature center at the radially inner side of the scroll inner peripheral wall 30*a* viewed in the axial direction and where the distance from the center O is the shortest, of the scroll inner peripheral wall 30*a* whose curvature radius gradually decreases along the rotational direction of the final-stage impeller 8A.

Thus, as in FIG. 4 described below, of the scroll inner peripheral wall 30*a*, at the side closer to the discharge outlet 18 from the position 75, the position 76 whose distance from the center O is the shortest in the region formed in a linear shape when viewed in the axial direction is not a position that corresponds to the scroll termination portion 45.

Figure 4:
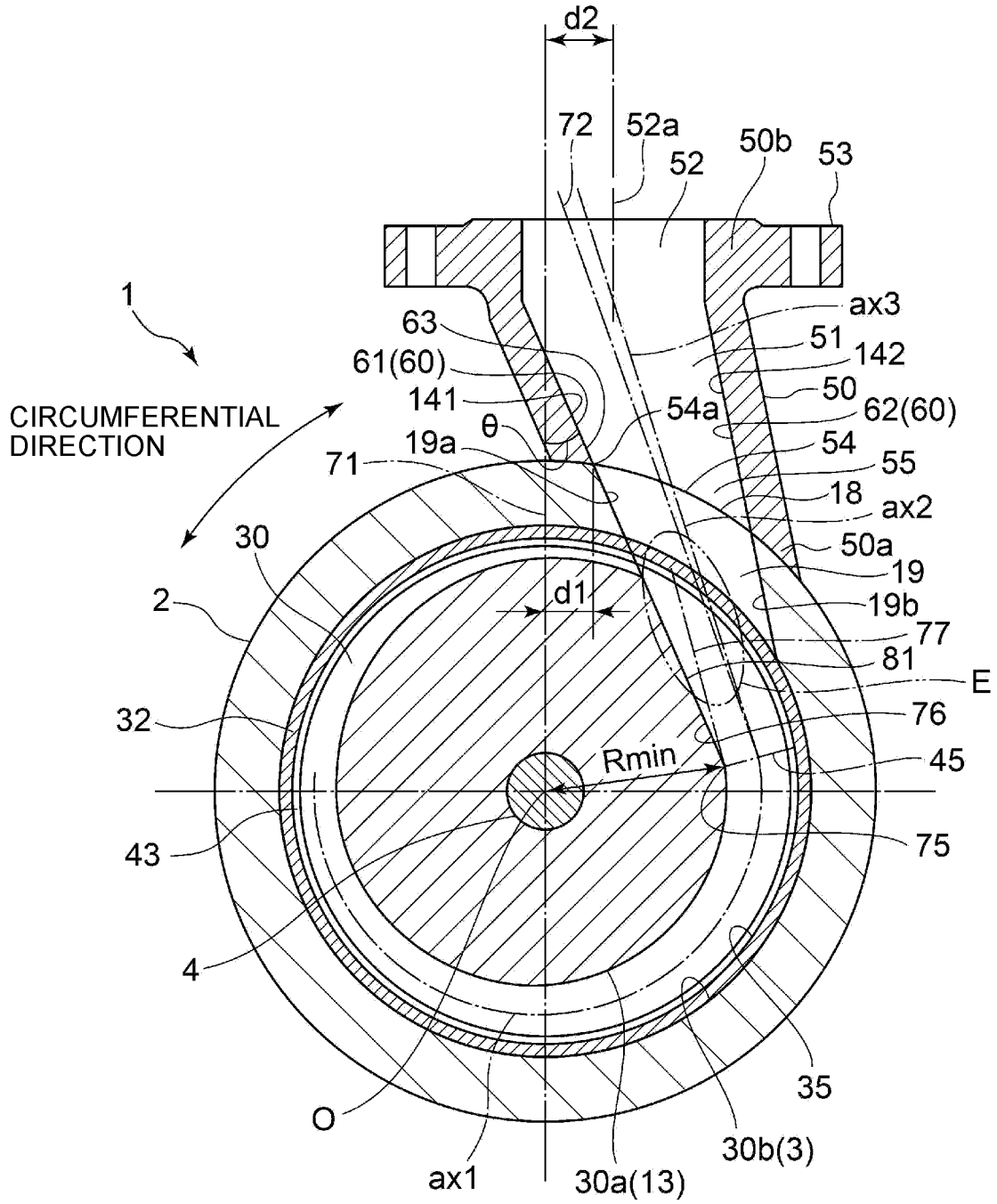
FIG. 4 is a cross-sectional view at a discharge outlet of a centrifugal compressor according to another embodiment, taken along the radial direction (i.e. viewed in the axial direction).
Figure 5:
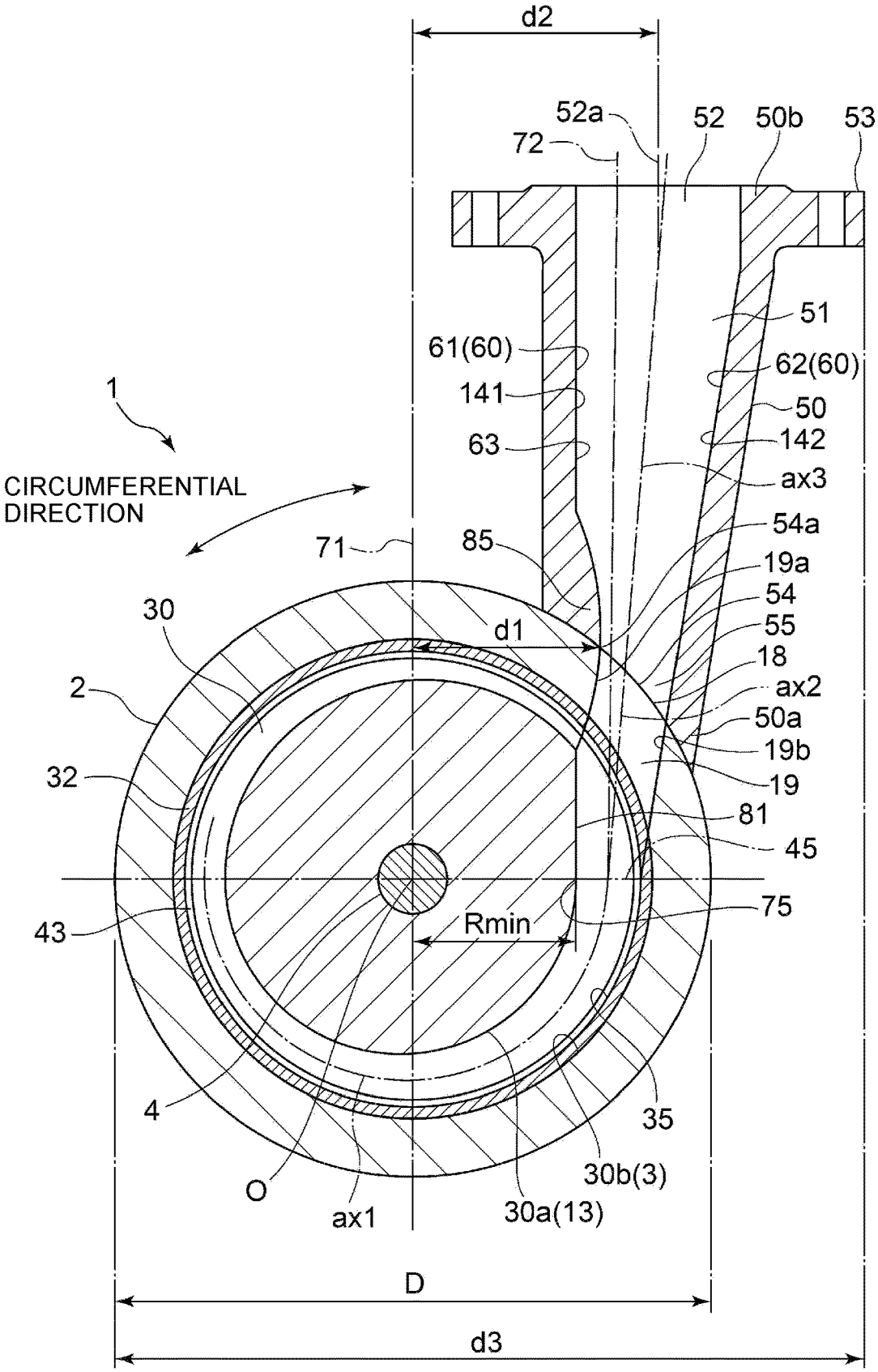
FIG. 5 is a cross-sectional view at a discharge outlet of a centrifugal compressor according to yet another embodiment, taken along the radial direction.
Figure 6:
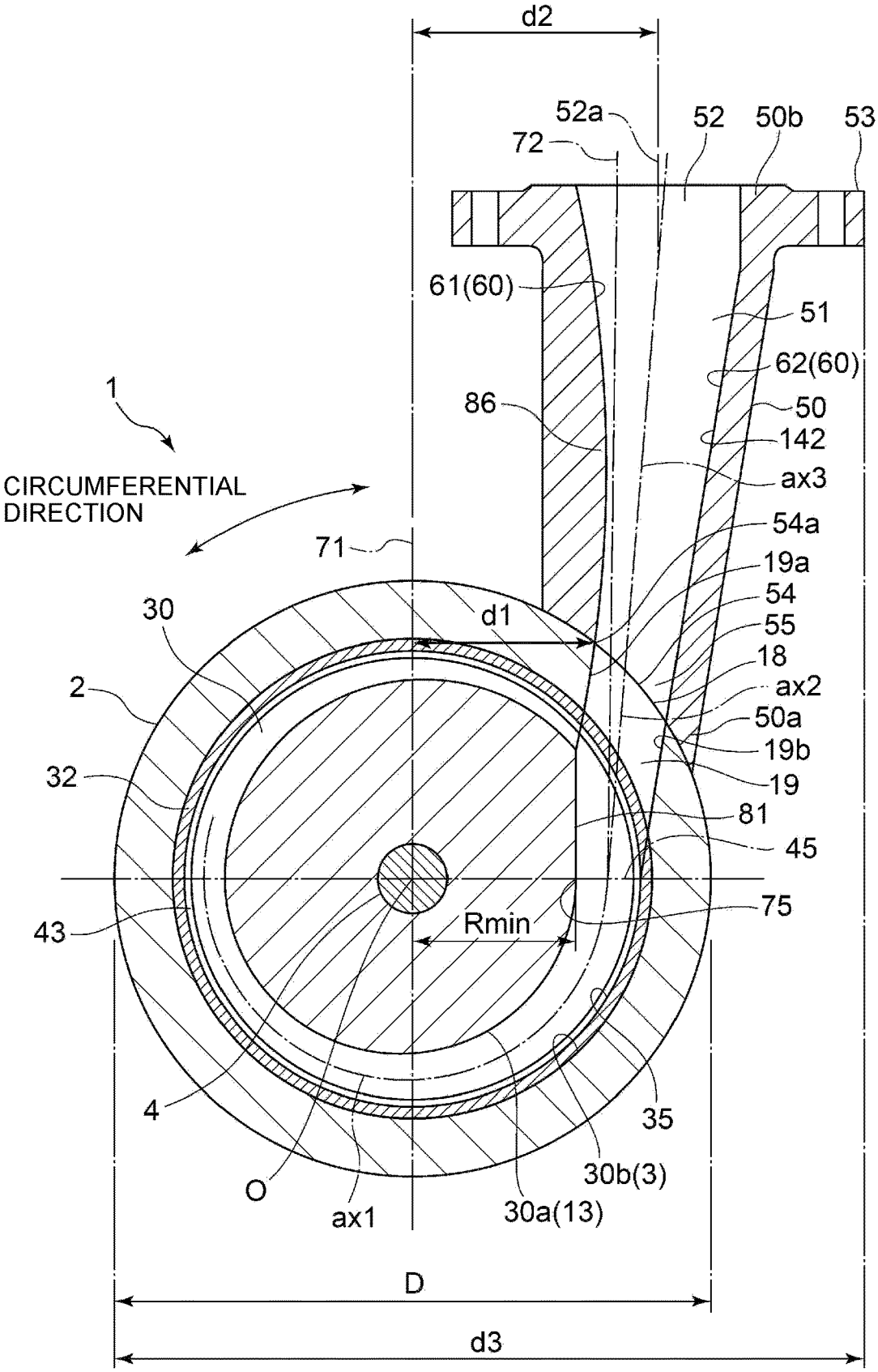
FIG. 6 is a cross-sectional view at a discharge outlet of a centrifugal compressor according to yet another embodiment, taken along the radial direction.

FIG. 4 is a cross-sectional view at the discharge outlet of a centrifugal compressor according to another embodiment, taken along the radial direction (i.e. viewed in the axial direction). FIG. 5 is a cross-sectional view at the discharge outlet of a centrifugal compressor according to yet another embodiment, taken along the radial direction. FIG. 6 is a cross-sectional view at the discharge outlet of a centrifugal compressor according to yet another embodiment, taken along the radial direction. Hereinafter, the description below will mainly refer to FIGS. 2, 4 to 6.

According to some embodiments, the centrifugal compressor 1 includes, as described above, impellers 8 fixed to the outer periphery of the rotary shaft 4, a diffuser 36 (see FIG. 3) disposed at the radially outer side of the impellers 8 (see FIG. 1), and a casing 2 that accommodates the impellers 8 and the diffuser 36. According to some embodiments, the centrifugal compressor 1 includes, as described above, the scroll flow passage 30 connected to the outlet 43 of the diffuser 36 and formed into a scroll shape by the scroll inner peripheral wall 30*a* and the scroll outer peripheral wall 30*b* positioned at the radially outer side of the scroll inner peripheral wall 30*a*, and the discharge pipe 50 connected to the casing 2 so as to form the discharge flow passage 51 for guiding the fluid from the scroll flow passage 30 to the outside of the casing 2. According to some embodiments, as described above, the scroll inner peripheral wall 30*a* of the centrifugal compressor 1 is positioned at the radially inner side of the outlet 43 of the diffuser 36.

In some embodiments, as depicted in FIGS. 2, 4 to 6, the discharge pipe 50 of the centrifugal compressor 1 has an inner wall surface 60 which has a radially inner region 61 continuing to the scroll inner peripheral wall 30*a*, the radially inner region 61 being positioned, when viewed in the axial direction of the rotary shaft 4, closer to the scroll termination portion 45 of the scroll flow passage 30 from the first line segment 71 which passes the center O of the rotary shaft 4 and which is parallel to the center axis 52*a* of the outlet portion 52 of the discharge pipe 50, at a connection position 54 of the discharge pipe 50 to the casing 2.

Thus, it is possible to orient the overall direction of the flow passage of the fluid from the scroll termination portion 45 of the scroll flow passage 30 to the outlet portion 52 of the discharge pipe 50 outward in the radial direction. Accordingly, it is possible to suppress the centrifugal force of the fluid in the vicinity of the scroll termination portion 45 and suppress separation of the fluid from the wall surface of the flow passage, thereby suppressing the performance deterioration of the centrifugal compressor 1.

According to some embodiments, as depicted in FIGS. 2 and 4, the centrifugal compressor 1 is configured such that the second line segment 72 obtained by extending a center line (the center line ax1) of the width, in the radial direction, of the scroll flow passage 30 in the extension direction at the scroll termination portion 45 passes through the opening of the outlet portion 52 of the discharge pipe 50. The embodiments depicted in FIGS. 5 and 6 have a similar configuration.

Accordingly, the flow passage of the fluid from the scroll termination portion 45 of the scroll flow passage 30 to the outlet portion 52 of the discharge pipe 50 is less bended, and it is possible to suppress pressure loss in the flow passage.

Each of the flow passages 30, 19, 51 will be described specifically.

In the scroll inner peripheral wall 30*a* according to the embodiments depicted in FIGS. 2, 5, and 6, the region 81 closer to the discharge outlet 18 from the position 75 whose distance from the center O is the shortest extends linearly in the same direction as the extension direction of the tangent to the scroll inner peripheral wall 30*a* at the position 75 whose distance from the center O is the shortest.

In the scroll inner peripheral wall 30*a* according to the embodiment depicted in FIG. 4, the region 81 closer to the discharge outlet 18 from the position 75 whose distance from the center O is the shortest extends so as to pass through the radially inner side of the tangent 77 of the scroll inner peripheral wall 30*a* at the position 75 whose distance from the center O is the shortest, that is, extends linearly in a region at the left side of the tangent 77 in FIG. 4.

Accordingly, it is possible to suppress separation of the fluid in the region 81 compared to a case where the region 81 closer to the discharge outlet 18 from the position 75 is formed to have a shape that further curves in the circumferential direction toward the discharge outlet 18.

In the embodiments depicted in FIGS. 2 and 4, the region 19*a* of the outlet flow passage 19 formed on the casing 2 continuing to the region 81 of the scroll inner peripheral wall 30*a* and the radially inner region 61 of the inner wall surface 60 of the discharge pipe 50 continuing to the region 81 of the scroll inner peripheral wall 30*a* via the region 19*a* extend linearly in the same direction as the extension direction of the region 81 of the scroll inner peripheral wall 30*a*. In the embodiments depicted in FIGS. 2 and 4, the region 81 of the scroll inner peripheral wall 30*a*, the region 19*a* of the outlet flow passage 19, and the radially inner region 61 of the discharge pipe 50 are disposed on the same line when viewed in the axial direction of the rotary shaft 4.

In the embodiment depicted in FIG. 5, of the radially inner region 61, the region closer to the second end 50*b* from the protruding portion 85 described below extends linearly in the same direction as the extension direction of the region 81 of the scroll inner peripheral wall 30*a*. That is, in the embodiment depicted in FIG. 5, the region 81 of the scroll inner peripheral wall 30*a*, and the region of the radially inner region 61 closer to the second end 50*b* from the protruding portion 85 are disposed on the same line when viewed in the axial direction of the rotary shaft 4.

As described above, in the embodiments depicted in FIGS. 2, 4, and 5, the radially inner region 61 has a linear shape portion 63 formed into a linear shape from the inlet portion 55 of the discharge pipe 50 toward the outlet portion 52 of the discharge pipe 50 in at least a partial region between the inlet portion 55 and the outlet portion 52, the region including the inlet portion 55.

Accordingly, the radially inner region 61 of the inner wall surface 60 of the discharge pipe 50 continuing to the scroll inner peripheral wall 30*a* is formed into a linear shape in at least a partial region, and thus the discharge flow passage 51 is less bended, which makes it possible to suppress pressure loss at the discharge flow passage 51.

The protruding portion 85 according to the embodiment depicted in FIG. 5 protrudes toward the inner side of the outlet flow passage 19 and the discharge flow passage 51, in the entire region 19*a* of the outlet flow passage 19 and in a region of the radially inner region 61 of the discharge pipe 50 at the side of the first end 50*a*.

In the embodiment depicted in FIG. 6, the protruding portion 86 protrudes toward the inner side of outlet flow passage 19 and the discharge flow passage 51, in the entire region 19*a* of the outlet flow passage 19 and from the first end 50*a* to the second end 50*b* of the radially inner region 61 of the discharge pipe 50.

The protruding portions 85, 86 each have a curvature radius at the side closer to the first line segment 71 from the radially inner region 61 when viewed in the axial direction of the rotary shaft 4.

In the embodiments depicted in FIGS. 2, 4, and 5, the intersecting angle θ (see FIG. 4) between the extension direction of the linear shape portion 63 from the inlet portion 55 toward the outlet portion 52 and the extension direction of the first line segment 71 is not greater than 30 angular degrees when viewed in the axial direction of the rotary shaft 4.

If the intersecting angle θ between the above extension direction of the linear shape portion 63 and the extension direction of the first line segment 71 exceeds 30 angular degrees when viewed in the axial direction of the rotary shaft 4, the direction of the flow passage of the fluid from the scroll termination portion 45 of the scroll flow passage 30 to the outlet portion 52 of the discharge pipe 50 becomes more inward in the radial direction, and thereby the centrifugal force of the fluid in the vicinity of the scroll termination portion 45 increases, which makes separation of the fluid from the wall surface of the flow passage more likely to occur.

In this regard, in the embodiments depicted in FIGS. 2, 4, and 5, the above intersecting angle θ is not greater than 30 angular degrees. Thus, it is possible to orient the flow passage of the fluid from the scroll termination portion 45 of the scroll flow passage 30 to the outlet portion 52 of the discharge pipe 50 less inward in the radial direction, and suppress the centrifugal force of the fluid in the vicinity of the scroll termination portion 45, thereby suppressing separation of the fluid from the wall surface of the flow passage.

In the embodiments depicted in FIGS. 2 and 5, the extension direction of the linear shape portion 63 from the inlet portion 55 toward the outlet portion 52 and the extension direction of the first line segment 71 coincide with one another, when viewed in the axial direction of the rotary shaft 4.

That is, in the embodiments depicted in FIGS. 2 and 5, the intersecting angle θ between the above extension direction of the linear shape portion 63 and the extension direction of the first line segment 71 is zero angular degrees, and thus it is possible to further suppress the centrifugal force of the fluid in the vicinity of the scroll termination portion 45, and further suppress separation of the fluid from the wall surface of the fluid from the scroll termination portion 45 of the scroll flow passage 30 to the outlet portion 52 of the discharge pipe 50.

In the embodiments depicted in FIGS. 2 and 4 to 6, the separation distance d1 between the first line segment 71 and the radially inner region 61 at the connection position 54 (that is, the position 54*a*) is not smaller than 0.2 times the minimum curvature radius Rmin of the scroll inner peripheral wall 30*a*, when viewed in the axial direction of the rotary shaft 4.

If the separation distance d1 between the position 54*a* and the first line segment 71 is smaller than 0.2 times the minimum curvature radius Rmin of the scroll inner peripheral wall, for instance, the direction of the flow passage of the fluid from the scroll termination portion 45 of the scroll flow passage 30 to the above position 54*a* becomes more inward in the radial direction, and thereby the centrifugal force of the fluid in the vicinity of the scroll termination portion 45 increases, which makes separation of the fluid from the wall surface of the flow passage more likely to occur.

In this regard, in the embodiments depicted in FIGS. 2, 4, and 6, the above separation distance d1 is not smaller than 0.2 times the minimum curvature radius Rmin of the scroll inner peripheral wall 30*a*, and thus it is possible to orient the flow passage of the fluid from the scroll termination portion 45 of the scroll flow passage 30 to the position 54 less inward in the radial direction, and suppress the centrifugal force of the fluid in the vicinity of the scroll termination portion 45, thereby suppressing separation of the fluid from the wall surface of the flow passage.

In the embodiment depicted in FIG. 2, the above described separation distance d1 is equal to the minimum curvature radius Rmin of the scroll inner peripheral wall 30*a*, when viewed in the axial direction of the rotary shaft 4.

Accordingly, it is possible to further suppress the centrifugal force of the fluid in the vicinity of the scroll termination portion 45, and further suppress separation of the fluid from the wall surface of the flow passage of the fluid from the scroll termination portion 45 to the above position 54*a*.

In the embodiments depicted in FIGS. 2 and 4 to 6, the separation distance d2 between the first line segment 71 and the center axis 52*a* of the outlet portion 52 of the discharge pipe 50 is not smaller than 0.3 times the minimum curvature radius Rmin of the scroll inner peripheral wall 30*a*, when viewed in the axial direction of the rotary shaft 4.

If the separation distance d2 between the center axis 52*a* of the outlet portion 52 of the discharge pipe 50 and the first line segment 71 is smaller than 0.3 times the minimum curvature radius Rmin of the scroll inner peripheral wall 30*a*, for instance, the direction of the flow passage of the fluid from the scroll termination portion 45 to the outlet portion 52 of the discharge pipe 50 becomes more inward in the radial direction, and thereby the centrifugal force of the fluid in the vicinity of the scroll termination portion 45 increases, which makes separation of the fluid from the wall surface of the flow passage more likely to occur.

In this regard, in the embodiments depicted in FIGS. 2, 4, and 6, the above separation distance d2 is not smaller than 0.3 times the minimum curvature radius Rmin of the scroll inner peripheral wall 30*a*, and thus it is possible to orient the flow passage of the fluid from the scroll termination portion 45 to the outlet portion 52 of the discharge pipe 50 less inward in the radial direction, and suppress the centrifugal force of the fluid in the vicinity of the scroll termination portion 45, thereby suppressing separation of the fluid from the wall surface of the flow passage.

In the embodiments depicted in FIGS. 2 and 4 to 6, the maximum width d3 of the centrifugal compressor 1 from the side surface of the flange portion 53 of the outlet portion 52 of the discharge pipe 50 is not greater than 1.2 times the casing outer shape D.

In the embodiments depicted in FIGS. 2 and 4 to 6, to suppress the centrifugal force of the fluid in the vicinity of the scroll termination portion 45 of the scroll flow passage 30, as described above, the radially inner region 61 is positioned closer to the scroll termination portion 45 of the scroll flow passage 30 from the first line segment 71 at the connection position 54. As a result, the outlet portion 52 of the discharge pipe 50 is positioned in the width direction, that is, in a direction orthogonal to the center axis 52*a* of the outlet portion 52 compared to a conventional centrifugal compressor, and thus the side surface of the flange portion 53 may extend further from the width of the casing 2.

In this regard, in the embodiments depicted in FIGS. 2 and 4 to 6, the maximum width d3 of the centrifugal compressor 1 from the side surface of the flange portion 53 of the outlet portion 52 of the discharge pipe 50 is not greater than 1.2 times the casing outer shape D, and thus it is possible to suppress a size increase of the centrifugal compressor 1 including the discharge pipe 50.

Figure 9:
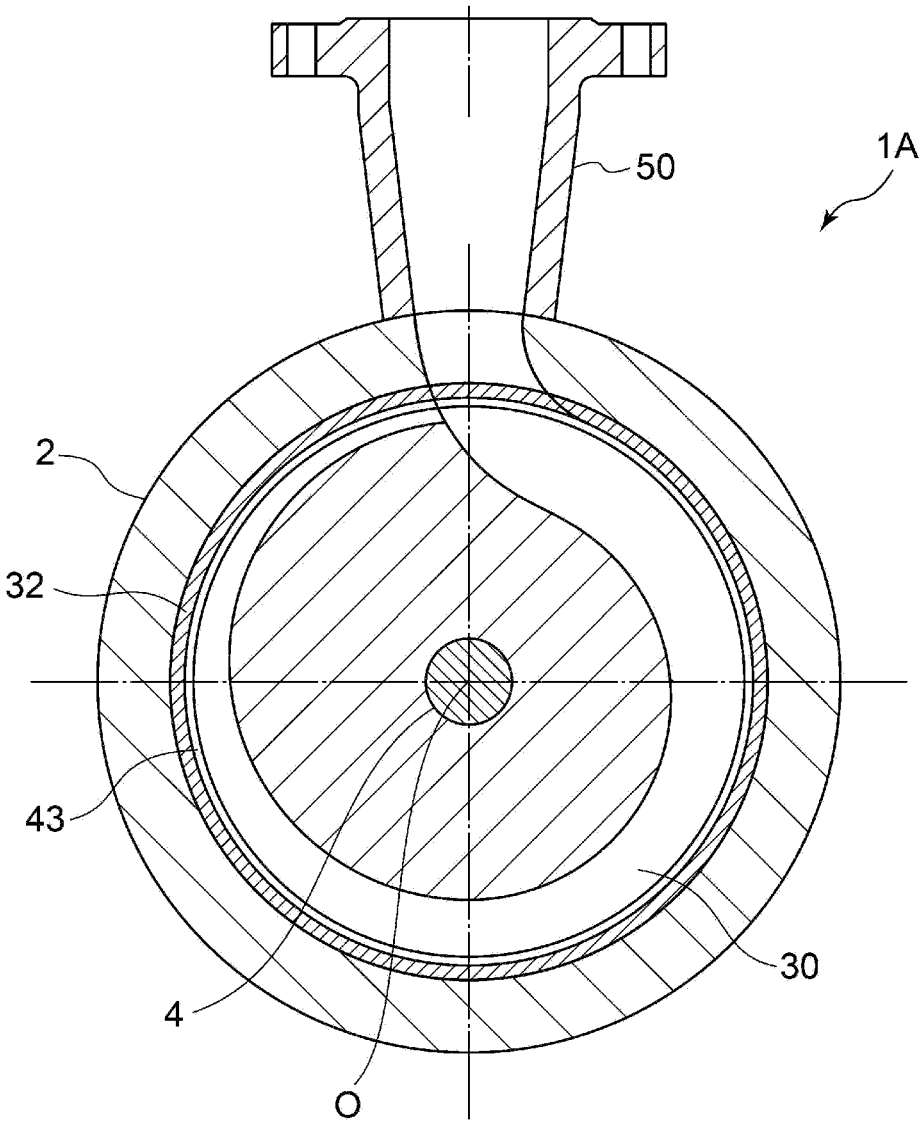
FIG. 9 is a cross-sectional view at a discharge outlet of a conventional centrifugal compressor.

Herein, FIG. 9 is a cross-sectional view at a discharge outlet of a conventional centrifugal compressor 1A.

In the embodiments depicted in FIGS. 2 and 4, the region 19*b* of the outlet flow passage 19 continuing to the scroll outer peripheral wall 30*b* and the radially outer region 62 of the inner wall surface 60 of the discharge pipe 50 continuing to scroll outer peripheral wall 30*b* via the above region 19*b* are arranged on the same line, when viewed in the axial direction of the rotary shaft 4. Furthermore, in the embodiments depicted in FIGS. 2 and 4, the region 19*b* and the radially outer region 62 are arranged such that the width of the flow passage of the outlet flow passage 19 and the discharge flow passage 51 viewed from the axial direction of the rotary shaft 4 increases toward the second end 50*b* of the discharge pipe 50.

In the embodiments depicted in FIGS. 5 and 6, the shapes of the region 19*b* and the radially outer region 62 when viewed from the axial direction of the rotary shaft 4 are the same as the shapes of the region 19*b* and the radially outer region 62 in the embodiments depicted in FIGS. 2 and 4.

That is, in the embodiments depicted in FIGS. 5 and 6, the shapes of the flow passages of the outlet flow passage 19 and the discharge flow passage 51 are the same as the shapes of the outlet flow passage 19 and the discharge flow passage 51 of the embodiment depicted in FIG. 2, except for the presence or absence of the protruding portion 85 or the protruding portion 86.

In the embodiments depicted in FIGS. 2 and 4, the outlet flow passage 19 has a rectangular cross-sectional shape when viewed in the extension direction of the outlet flow passage 19, that is, in a direction of the main flow of the fluid passing through the outlet flow passage 19. In the following description, a virtual line passing through the center of the cross section will be referred to as the center line ax2 of the outlet flow passage 19.

Furthermore, in the embodiments depicted in FIGS. 2 and 4, the discharge flow passage 51 has a rectangular cross-sectional shape at the side of the first end 50*a* and a circular shape at the side of the second end 50*b*, when viewed in the extension direction of the discharge flow passage 51, that is, in a direction of the main flow of the fluid passing through the discharge flow passage 51. In the following description, a virtual line passing through the center of the cross section will be referred to as the center line ax3 of the discharge flow passage 51.

The inner wall surface 60 of the discharge pipe 50 has a change portion 56 whose cross-sectional shape gradually changes from a rectangular shape to a circular shape from the inlet portion 55 toward the outlet portion 52.

Figure 7:
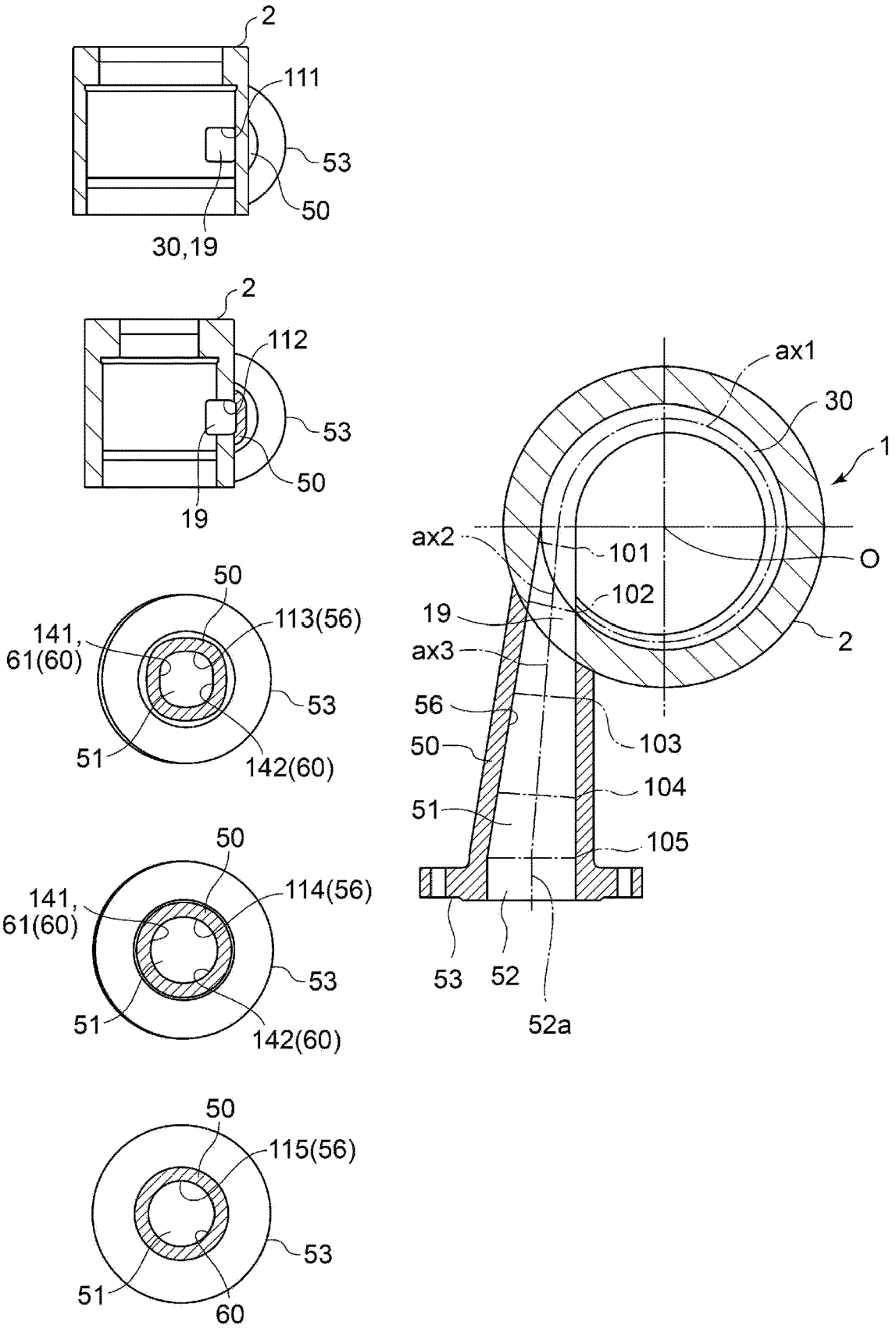
FIG. 7 is a diagram for describing how the cross-sectional shape changes at the change portion according to the embodiment depicted in FIG. 2.
Figure 8:
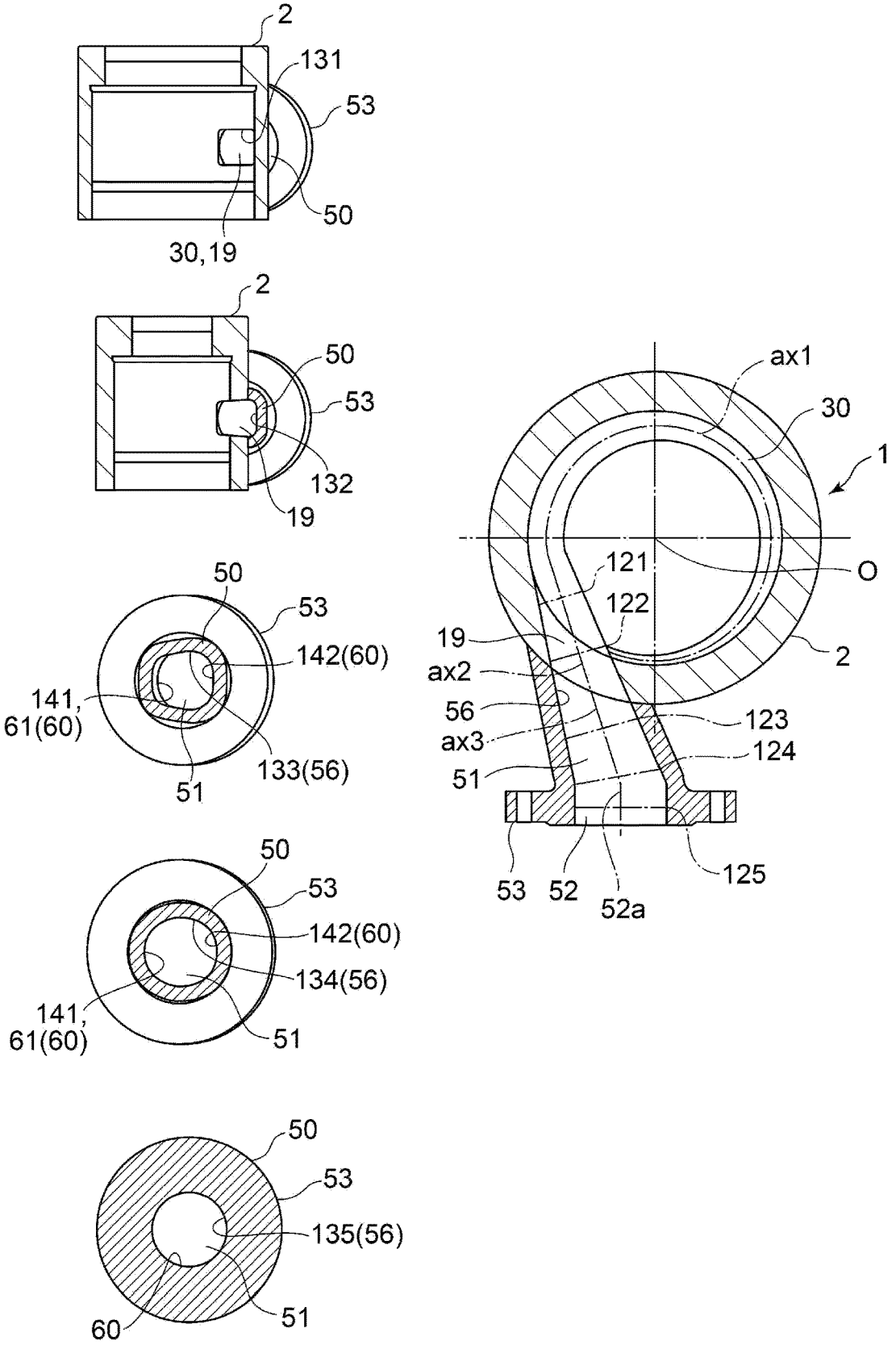
FIG. 8 is a diagram for describing how the cross-sectional shape changes at the change portion according to the embodiment depicted in FIG. 4.

FIG. 7 is a diagram for describing how the cross-sectional shape changes at the change portion 56 according to the embodiment depicted in FIG. 2, showing cross-sectional shapes perpendicular to the center lines ax1, ax2, and the center axis 52*a*. FIG. 8 is a diagram for describing how the cross-sectional shape changes at the change portion 56 according to the embodiment depicted in FIG. 4, showing cross-sectional shapes perpendicular to the center lines ax1, ax2, and the center axis 52*a*.

In FIG. 7, depicted are the shape of the cross section 111 of the scroll flow passage 30 at the first position 101, the shape of the cross section 112 of the outlet flow passage 19 at the second position 102, and the shapes of the cross sections 113 to 115 of the discharge flow passage 51 at the third position 103 to the fifth position 105.

The first position 101 is a position slightly closer to the outlet flow passage 19 from the scroll termination portion 45, and the second position 102 is a position inside the outlet flow passage 19. The third position 103 to the fifth position 105 are positions inside the discharge flow passage, and arranged from the first end 50*a* toward the second end 50*b* in the following order: the third position 103, the fourth position 104, and the fifth position 105.

As depicted in FIG. 7, the shape of the cross section 111 of the scroll flow passage 30 at the first position 101 and the shape of the cross section 112 of the outlet flow passage 19 at the second position 102 are substantially rectangular. The shapes of the cross sections 113 to 115 of the discharge flow passage 51 at the third position 103 to the fifth position 105 change from a rectangular shape to a circular shape gradually from the inlet portion 55 toward the outlet portion 52.

In FIG. 8, depicted are the shape of the cross section 131 of the scroll flow passage 30 at the first position 121, the shape of the cross section 132 of the outlet flow passage 19 at the second position 122, and the shapes of the cross sections 133 to 135 of the discharge flow passage 51 at the third position 123 to the fifth position 125.

The first position 121 is a position closer to the outlet flow passage 19 from the scroll termination portion 45, and the second position 122 is a position inside the outlet flow passage 19. The third position 123 to the fifth position 125 are positions inside the discharge flow passage 51, and are arranged from the first end 50*a* toward the second end 50*b* in the following order: the third position 123, the fourth position 124, and the fifth position 125.

As depicted in FIG. 8, the shape of the cross section 131 of the scroll flow passage 30 at the first position 121 and the shape of the cross section 132 of the outlet flow passage 19 at the second position 122 are substantially rectangular. The shapes of the cross sections 133 to 135 of the discharge flow passage 51 at the third position 123 to the fifth position 125 change from a rectangular shape to a circular shape gradually from the inlet portion 55 toward the outlet portion 52.

The inner wall surface 60 of the discharge pipe 50 at the change portion 56 has an inner side wall surface 141 continuing to the scroll inner peripheral wall 30*a* and an outer side wall surface 142 continuing to the scroll outer peripheral wall 30*b* and facing the inner side wall surface 141. Further, the radially inner region 61 includes a region of the inner side wall surface 141.

Accordingly, the cross-sectional shape gradually changes from a rectangular shape toward a circular shape at the change portion 56 from the inlet portion 55 toward the outlet portion 52 of the discharge pipe 50, and thus the cross-sectional shape does not change abruptly, which makes it possible to suppress separation of the fluid from the inner side wall surface 141 in the discharge pipe 50.

In the embodiments depicted in FIGS. 5 and 6, the radially inner region 61 includes protruding portions 85, 86 protruding toward the inner side of the discharge flow passage 51, in at least a partial region between the inlet portion 55 and the outlet portion 52 of the discharge pipe 50.

Accordingly, the protruding portions 85, 86 are formed in a region of the discharge flow passage 51 where separation of the fluid is likely to occur, and thus it is possible to suppress separation of the fluid from the wall surface of the discharge flow passage 51.

Embodiments of the present invention were described in detail above, but the present invention is not limited thereto, and various amendments and modifications may be implemented.

For instance, while the centrifugal compressor 1 is a multi-stage centrifugal compressor including a plurality of stages of impellers in the above described embodiments, the centrifugal compressor 1 may be a single-stage centrifugal compressor with a single stage of impeller.

REFERENCE SIGNS LIST

1 Centrifugal compressor
2 Casing
4 Rotary shaft
8 Impeller
19 Outlet flow passage
30 Scroll flow passage
30*a* Scroll inner peripheral wall
30*b* Scroll outer peripheral wall
36 Diffuser
43 Outlet
45 Scroll termination portion
50 Discharge pipe
51 Discharge flow passage
52 Outlet portion
54 Connection position
55 Inlet portion
56 Change portion
60 Inner wall surface
61 Radially inner region
63 Linear shape portion
71 First line segment
72 Second line segment
85, 86 Protruding portion

The invention claimed is:

1. A centrifugal compressor, comprising:

an impeller fixed on an outer periphery of a rotary shaft;

a diffuser disposed at a radially outer side of the impeller;

a casing accommodating the impeller and the diffuser;

a scroll flow passage connected to an outlet of the diffuser, the scroll flow passage being formed into a scroll shape by a scroll inner peripheral wall and a scroll outer peripheral wall positioned at a radially outer side of the scroll inner peripheral wall; and a discharge pipe connected to the casing so as to form a discharge flow passage for guiding a fluid from the scroll flow passage to outside of the casing, wherein the scroll inner peripheral wall is positioned at an inner side, in a radial direction, of the outlet of the diffuser, wherein the discharge pipe comprises an inner wall surface that has a radially inner region continuing to the scroll inner peripheral wall, wherein a connection position of the radially inner region to the casing is positioned on a same side of a first line segment that passes a center of the rotary shaft and that is parallel to a center axis of an outlet portion of the discharge pipe as a scroll termination portion of the scroll flow passage when viewed in an axial direction of the rotary shaft, and wherein the radially inner region comprises a protruding portion that protrudes toward an inner side of the discharge flow passage in at least a partial region between an inlet portion of the discharge pipe and the outlet portion.

2. The centrifugal compressor according to claim 1, wherein a second line segment obtained by extending a center line of a width, in the radial direction, of the scroll flow passage in an extension direction at the scroll termination portion passes through an opening of the outlet portion of the discharge pipe.

3. The centrifugal compressor according to claim 1, wherein the radially inner region has a linear shape portion formed into a linear shape from an inlet portion of the discharge pipe toward the outlet portion of the discharge pipe in at least a partial region between the inlet portion and the outlet portion, the region including the inlet portion.

4. The centrifugal compressor according to claim 3, wherein an intersecting angle between an extension direction of the linear shape portion from the inlet portion toward the outlet portion and an extension direction of the first line segment is not greater than 30 angular degrees when viewed in the axial direction of the rotary shaft.

5. The centrifugal compressor according to claim 4, wherein the extension direction of the linear shape portion from the inlet portion toward the outlet portion coincides with the extension direction of the first line segment, when viewed in the axial direction of the rotary shaft.

6. The centrifugal compressor according to claim 1, wherein a separation distance between the first line segment and the radially inner region at the connection position of the discharge pipe to the casing is not smaller than 0.2 times a minimum curvature radius of the scroll inner peripheral wall, when viewed in the axial direction of the rotary shaft.

7. The centrifugal compressor according to claim 6, wherein the separation distance between the first line segment and the radially inner region at the connection position of the discharge pipe to the casing is equal to the minimum curvature radius of the scroll inner peripheral wall, when viewed in the axial direction of the rotary shaft.

8. The centrifugal compressor according to claim 1, wherein a separation distance between the first line segment and a center axis of the outlet portion of the discharge pipe when viewed in the axial direction of the rotary shaft is not smaller than 0.3 times a minimum curvature radius of the scroll inner peripheral wall.

9. The centrifugal compressor according to claim 1, wherein an inner wall surface of the discharge pipe has a changing portion whose cross-sectional shape viewed in an extension direction of the discharge flow passage has a rectangular shape at an inlet portion of the discharge pipe and a circular shape at the outlet portion, the cross-sectional shape gradually changing from the rectangular shape toward the circular shape from the inlet portion toward the outlet portion, wherein the inner wall surface of the discharge pipe at the changing portion has an inner side wall surface continuing to the scroll inner peripheral wall and an outer side wall surface continuing to the scroll outer peripheral wall and facing the inner side wall surface, and wherein the radially inner region includes a region of the inner side wall surface.

* * * * *